US012366414B2

(12) United States Patent
Pawlak et al.

(10) Patent No.: US 12,366,414 B2
(45) Date of Patent: Jul. 22, 2025

(54) HEAT EXCHANGER

(71) Applicant: Valeo Autosystemy Sp. z o.o., Skawina (PL)

(72) Inventors: Damian Pawlak, Skawina (PL); Michal Fajkis, Skawina (PL); Pawel Sus, Bad Rodach (DE)

(73) Assignee: Valeo Autosystemy Sp. z o.o., Skawina (PL)

( * ) Notice: Subject to any disclaimer, the term of this patent is extended or adjusted under 35 U.S.C. 154(b) by 222 days.

(21) Appl. No.: 18/017,518

(22) PCT Filed: Jun. 30, 2021

(86) PCT No.: PCT/EP2021/068052
§ 371 (c)(1),
(2) Date: Jan. 23, 2023

(87) PCT Pub. No.: WO2022/017751
PCT Pub. Date: Jan. 27, 2022

(65) Prior Publication Data

US 2023/0358478 A1 Nov. 9, 2023

(30) Foreign Application Priority Data

Jul. 23, 2020 (EP) ..... 20461547

(51) Int. Cl.
*F28F 9/00* (2006.01)
*F28D 1/053* (2006.01)
(Continued)

(52) U.S. Cl.
CPC ..... *F28D 1/05375* (2013.01); *F28F 9/0209* (2013.01); *F28F 9/0224* (2013.01);
(Continued)

(58) Field of Classification Search
CPC .... F28F 9/0246; F28F 9/0209; F28F 2280/06; F28F 9/0265; F28F 9/0263; F28F 9/026;
(Continued)

(56) References Cited

U.S. PATENT DOCUMENTS 5,101,890 A * 4/1992 Aoki ..... F28F 9/0212 165/110
6,116,335 A 9/2000 Beamer et al.
(Continued)

FOREIGN PATENT DOCUMENTS

EP 1746377 A1 1/2007
EP 3361204 A1 8/2018
(Continued)

OTHER PUBLICATIONS

International Search Report and Written Opinion in corresponding International Application No. PCT/EP2021/068052, dated Aug. 19, 2021 (10 pages).

*Primary Examiner* — Frantz F Jules
*Assistant Examiner* — Jason N Thompson
(74) *Attorney, Agent, or Firm* — Osha Bergman Watanabe & Burton LLP

(57) ABSTRACT

A heat exchanger includes an inlet tank (10*a*) connected to and in fluid communication with an inlet pipe (12*a*) for ingress of a coolant therein, an outlet tank (10*b*) connected to and in fluid communication with an outlet pipe (12*b*) for egress of coolant there from. The heat exchanger further includes heat exchange tubes (20) and a tubular element (30) to configure fluid communication between the inlet tank (10*a*) and the outlet tank (10*b*). A first side of the outlet tank (10*b*) is complimentary to and connected to the outlet pipe (12*b*) and an opposite second side of the outlet tank (10*b*) is complimentary to and aligned with the tubular element (30). The tubular element (30) and the outlet pipe (12*b*) are of different cross sections, wherein shape of the outlet tank
(Continued)

Figure 1A:
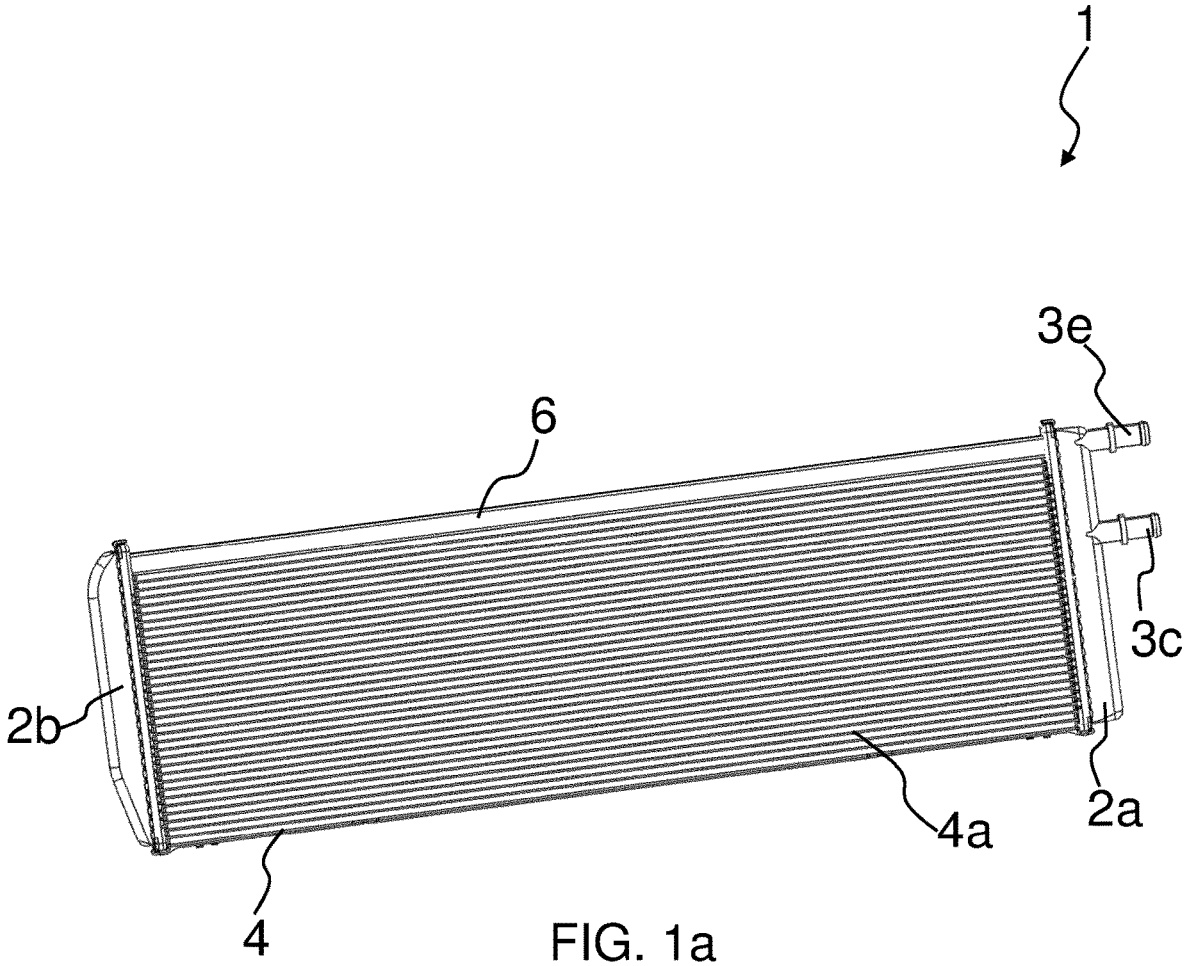
FIG. 1a (PRIOR ART)

(10*b*) transforms smoothly between those cross sections along fluid path.

15 Claims, 8 Drawing Sheets

(51) Int. Cl.
*F28F 9/02* (2006.01)
*F28D 21/00* (2006.01)

(52) U.S. Cl.
CPC ..... *F28F 9/0248* (2013.01); *F28F 9/0263* (2013.01); *F28D 2021/0091* (2013.01)

(58) Field of Classification Search
CPC ..... F28F 9/0231; F28F 9/0224; F28F 9/001; F28F 9/0219
See application file for complete search history.

(56) References Cited

U.S. PATENT DOCUMENTS

2003/0159816 A1* 8/2003 Kodumudi ..... F28F 9/0246 165/178
2005/0092475 A1* 5/2005 Ambros ..... F28D 1/0535 165/177
2007/0209787 A1* 9/2007 Hiyama ..... F28F 9/0246 165/178
2007/0251678 A1* 11/2007 Vorpahl ..... F28F 9/0246 165/139
2009/0090494 A1* 4/2009 Seidler ..... F28F 9/0231 165/158
2010/0199955 A1* 8/2010 Smith ..... F28D 1/05366 123/542
2011/0303402 A1* 12/2011 Gu ..... F28F 9/0251 165/182
2016/0131430 A1* 5/2016 Mazzoni ..... F28F 9/0282 165/174
2018/0038661 A1* 2/2018 Hornig ..... F28F 9/02
2018/0238627 A1* 8/2018 Herring ..... F28F 13/08
2019/0170453 A1* 6/2019 McCaffrey ..... F28F 9/0214
2020/0224580 A1* 7/2020 Usuki ..... F28D 1/05366

FOREIGN PATENT DOCUMENTS

EP 3540357 A1 9/2019
GB 1479093 A 7/1977
WO 2014-056151 A1 4/2014

* cited by examiner

HEAT EXCHANGER

The present invention relates to a heat exchanger, particularly, the present invention relates to a compact heat exchanger for use in a vehicle.

A vehicle generally includes a number of heat exchangers, such as for example a radiator, evaporator and a condenser. The heat exchanger for use in the vehicle is to be packaged in a limited space due to space constraints and accordingly, is required to be compact. Generally, compactness of the heat exchanger is achieved by limiting the size of a core of the heat exchanger, particularly, by reducing the number of heat exchange tubes. However, by reducing the number of heat exchange tubes, the pressure drop across the heat exchange tubes, particularly, pressure drop across the heat exchanger core is increased. In spite of fewer heat exchange tubes for imparting compactness to the heat exchanger, the flow rate of the coolant flowing through the heat exchange tubes is required to be maintained by increasing the flow velocity, particularly, by increasing the pressure drop across the heat exchanger tubes. With increase in flow velocity of coolant flowing through first heat exchange tubes, problems such as inefficient heat exchange arises. The inefficient heat exchange due to increase in flow velocity of coolant flowing through first heat exchange tubes adversely affects the performance of the heat exchanger. Further, the increase in pressure drop across the heat exchange tubes give rise to need of a higher capacity pump to cause the coolant to flow across the heat exchanger core. The need of higher capacity pump increases the overall cost of the coolant loop.

In order to address the above mentioned problems such as need of higher capacity pump due to increase in pressure drop across the heat exchange tubes and inefficient operation of the heat exchanger due to increase in flow velocity, an additional tube is used. The additional tube connects and configures fluid communication between an inlet tank and an outlet tank of the heat exchanger. In case of an I-flow or Z-flow, the inlet tank and the outlet tank are disposed on opposite sides of the heat exchanger core. Whereas in case of the U-flow the inlet tank and the outlet tank are disposed along same side of the heat exchanger core and an intermediate tank is disposed on a side opposite to the side on which the inlet tank and outlet tank are disposed. Accordingly, the additional tube configures fluid communication between intermediate tank and outlet tank in case of U-flow and inlet and outlet tank in case of I flow or Z flow. The additional tube is having larger cross sectional dimension compared to the remaining individual heat exchanger tubes, consequently the flow rate through the additional tube is greater than through the heat exchange tube of the core. The main function of the additional tube is to enhance fluid flow there through as the additional tube configures fluid communication between the inlet tank and the outlet tank. The additional tube further provides a robust reinforcement of the structure of the heat exchanger due to its shape. Although there is some extent of heat exchange between the first heat exchange fluid flowing through the additional tube and air flowing outside the additional tube, such heat exchange is limited or minimal. In one example, the additional tube forms a return flow passage from the intermediate tank to the outlet tank, in case the heat exchange tubes along with the additional tube are configuring U-flow. Similarly, in other example, the additional tube forms flow passage from the inlet tank to the outlet tank, in case the heat exchange tubes along with the additional tube are configuring I flow or Z flow. The additional tube is of rectangular cross section and comparatively larger internal dimension than the heat exchange tubes, such configuration of the additional tube provides limited pressure drop there across. The slowing of the flow through the additional tube defeats the purpose of using the additional tube. Further, the transition of flow from the additional tube to an outlet pipe through the outlet tank is not smooth and causes flow/energy losses. Further, the outlet tank and the outlet pipe faces packing issues. More specifically, the rectangular cross-section of the additional tube provides a robust reinforcement to the structure at low cost. However, such shape and sizing complicates effective optimization of the heat exchanger in view of restrictive space constraints, especially concerning fluid inlet and outlet of the heat exchanger.

Accordingly, there is a need for a heat exchanger with features incorporated in an inlet tank, an outlet tank, and an intermediate tank to decrease internal pressure drop across whole heat exchanger to improve fluid flow through the whole heat exchanger, thereby limiting dependency on external power source such as pump. Further, there is a need for a heat exchanger that permits use of lower capacity pump for fluid flow between the inlet tank and the outlet tank. Still further, there is a need for a heat exchanger that addresses the issues such as flow/energy losses due to transition of flow cross section not being smooth as coolant flows from the additional tube to the outlet pipe through the outlet tank. In addition, there is a need for a heat exchanger that is compact and addresses packaging issues. Furthermore, there is a need for a heat exchanger that is compact but still is energy efficient and comparatively inexpensive. Further, there is need for a heat exchanger that exhibits improved efficiency due to decreased internal pressure drop across the whole heat exchanger.

An object of the present invention is provide a heat exchanger that obviates the drawbacks with conventional heat exchangers, particularly, that obviates problems with flow across the heat exchanger core and inefficient operation of the heat exchanger by reducing internal pressure drop across the whole heat exchanger.

Yet another object of the present invention is to provide a heat exchanger that ensures smooth transition of flow cross section from the additional tube to the outlet pipe through the outlet tank, thereby preventing flow/energy losses.

Still another object of the present invention is to provide a heat exchanger that is compact and addresses the packaging issues associated with conventional heat exchangers.

Another object of the present invention is to provide a heat exchanger with features incorporated in at least one of an inlet tank, an outlet tank and an intermediate tank to decrease internal pressure drop across the whole heat exchanger.

Still another object of the present invention is to provide a heat exchanger that permits use of lower capacity pump for fluid flow between the inlet tank and the outlet tank.

Yet another object of the present invention is to provide a heat exchanger that eliminates at least one side plate by commonization of parts.

Still another object of the present invention is to provide a heat exchanger that permits use of shorter core with use of lower capacity pump, thereby is compact, inexpensive and energy efficient.

In the present description, some elements or parameters may be indexed, such as a first element and a second element. In this case, unless stated otherwise, this indexation is only meant to differentiate and name elements, which are similar but not identical. No idea of priority should be inferred from such indexation, as these terms may be switched without betraying the invention. Additionally, this indexation does not imply any order in mounting or use of the elements of the invention.

A heat exchanger is disclosed in accordance with an embodiment of the present invention. The heat exchanger includes an inlet tank, an outlet tank, a plurality of heat exchange tubes and a tubular element. The inlet tank is connected to and in fluid communication with an inlet pipe for ingress of a first heat exchange fluid into the inlet tank. The outlet tank is connected to and in fluid communication with an outlet pipe for egress of the first heat exchange fluid from the outlet tank. The plurality of heat exchange tubes and the tubular element configures fluid communication between the inlet tank and the outlet tank. A first side of the outlet tank is complimentary to and connected to the outlet pipe. A second side of the outlet tank opposite to the first side is complimentary to and aligned with the tubular element. The tubular element and the outlet pipe are of different cross-sections. The shape of the outlet tank transforms smoothly between those cross-sections along the fluid path.

Generally, the inlet tank is in fluid communication with and supplies the first heat exchange fluid to the heat exchange tubes and the outlet tank is in fluid communication with and collects the first heat exchange fluid only from the tubular element.

Specifically, the inlet tank is of variable cross section and the cross section thereof is decreasing in a direction away from the inlet pipe.

In accordance with an embodiment, the tubular element and the outlet pipe are of same cross sectional area and different shapes.

Further, the tubular element and the outlet pipe are co-axial.

Alternatively, the tubular element and the outlet pipe at an angle with respect to each other.

Furthermore, the inlet pipe and the outlet pipe are parallel with respect to each other.

Alternatively, the inlet pipe and the outlet pipe are at an angle with respect to each other.

Generally, the inlet pipe is disposed proximal to an interface between the inlet tank and the outlet tank and fluid flows away from the inlet pipe.

Generally, the inlet tank and the outlet tank are crimped to a first header configured with a first set of slots to receive one end of the plurality of heat exchange tubes and a first aperture to receive one end of the tubular element.

Specifically, the outlet pipe is of circular cross section and the tubular element is of rectangular cross section, cross section of the outlet tank changes from circular at the first side thereof to rectangular at the second side thereof.

More specifically, the outlet pipe is of circular cross section and the tubular element is of square cross section, the cross section of the outlet tank changes from circular at the first side thereof to square at the second side thereof.

More specifically, the outlet tank is of larger dimension at the second side as compared to the first side, thereby is converging towards the first side thereof.

Generally, the heat exchange tubes and the tubular element configure either one of U-flow and Z-flow Further, the heat exchanger includes an intermediate tank that is in fluid communication with the heat exchange tubes and the tubular element, the intermediate tank collects the first heat exchange fluid from the heat exchange tubes and delivers the collected first heat exchange fluid to the tubular element. The intermediate tank is of variable cross section and the cross section thereof is increasing towards an entrance of the tubular element with maximum cross section at the entrance of the tubular element.

Still further, the intermediate tank is crimped to a second header configured with a second set of slots to receive opposite end of the plurality of heat exchange tubes and a second aperture to receive the opposite end of the tubular element.

Figure 1B:
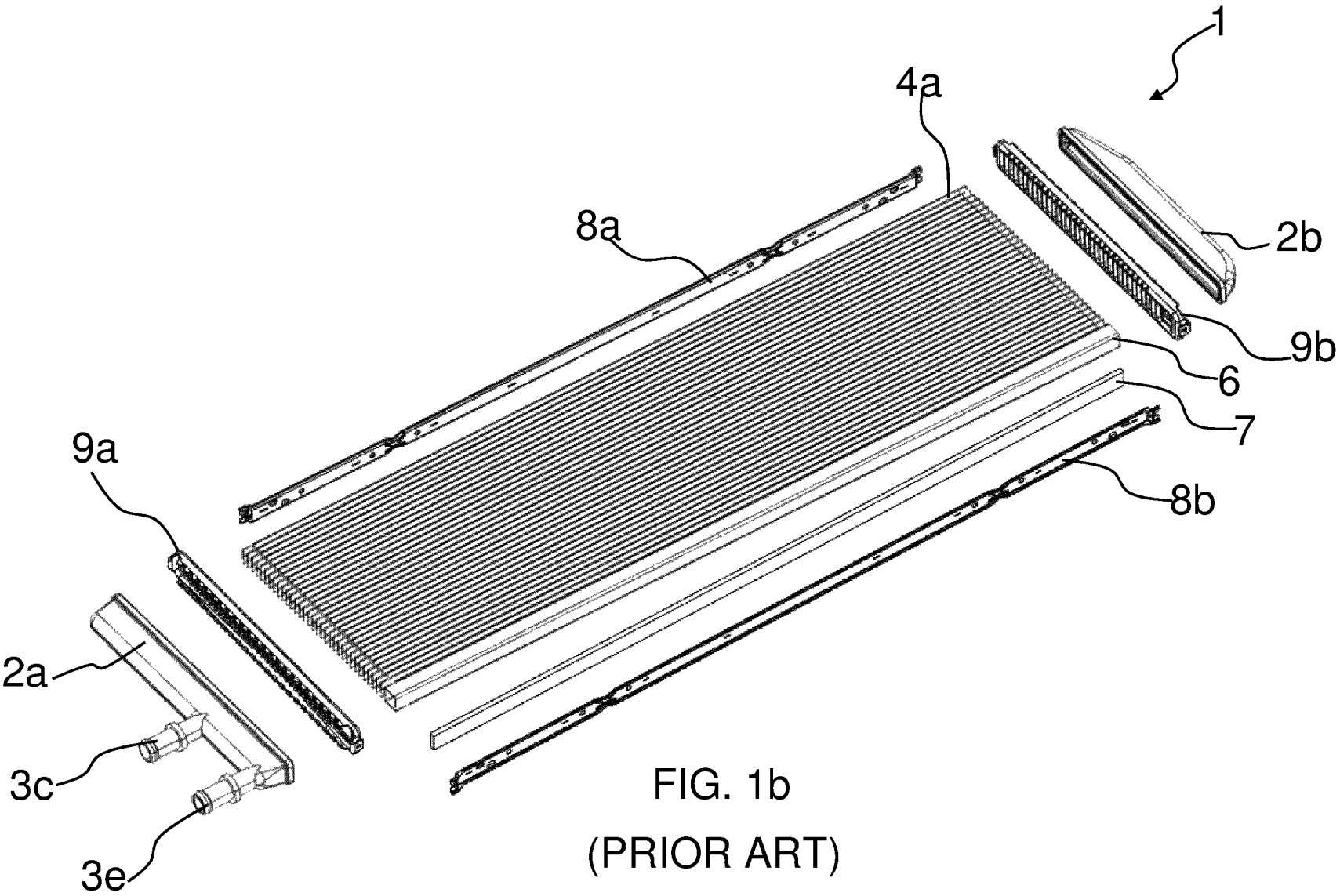
FIG. 1b (PRIOR ART)

Other characteristics, details and advantages of the invention can be inferred from the description of the invention hereunder. A more complete appreciation of the invention and many of the attendant advantages thereof will be readily obtained as the same becomes better understood by reference to the following detailed description when considered in connection with the accompanying figures, wherein:

FIG. 1*a* illustrates an isometric view of a conventional heat exchanger, wherein a baffle disposed inside a tank configures an inlet tank and an outlet tank on same side of a heat exchanger core of the conventional heat exchanger;

FIG. 1*b* illustrates an exploded view of the conventional heat exchanger of FIG. 1*a;*

Figure 2A:
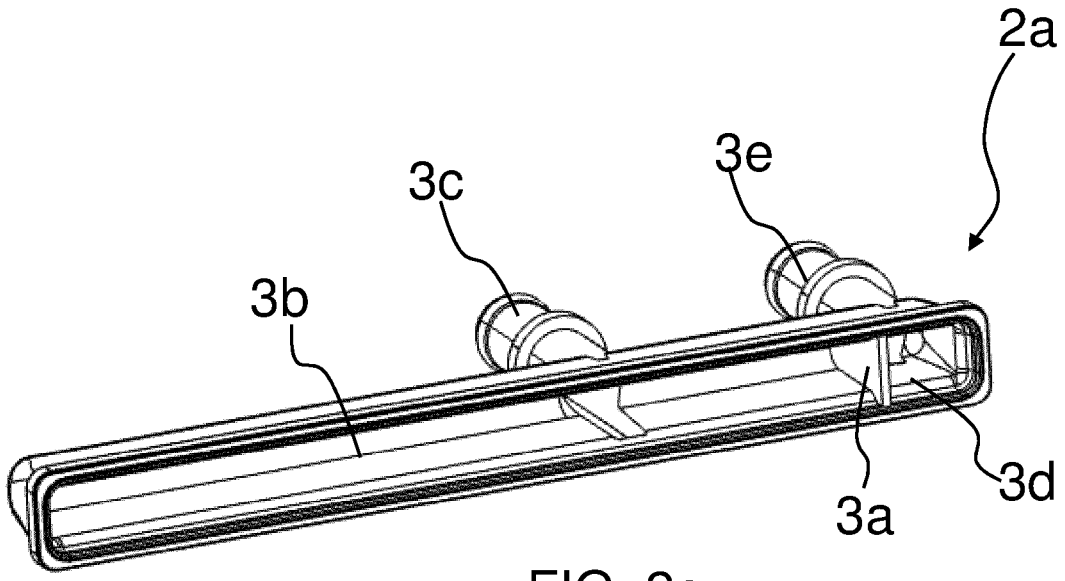
FIG. 2a (PRIOR ART)

FIG. 2*a* illustrates an isometric view of the tank with the baffle disposed inside the tank to configure the inlet tank and the outlet tank of the conventional heat exchanger of FIG. 1*a;*

Figure 2B:
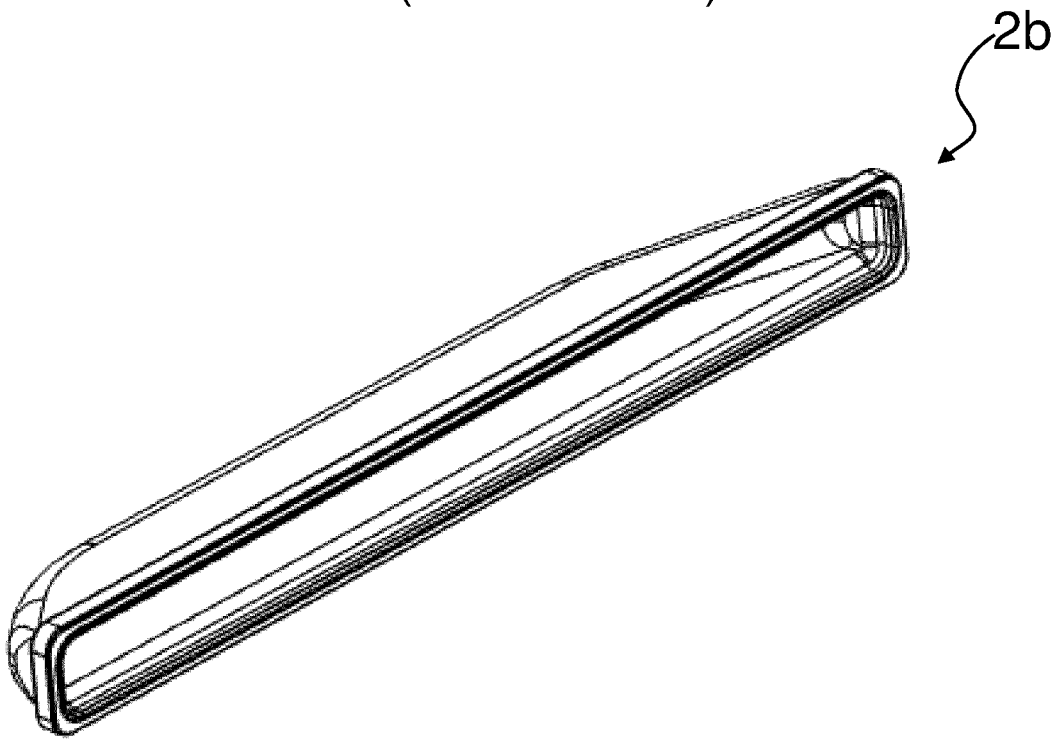
FIG. 2b (PRIOR ART)

FIG. 2*b* illustrates an isometric view of an intermediate tank of the conventional heat exchanger of FIG. 1*a;*

Figure 3A:
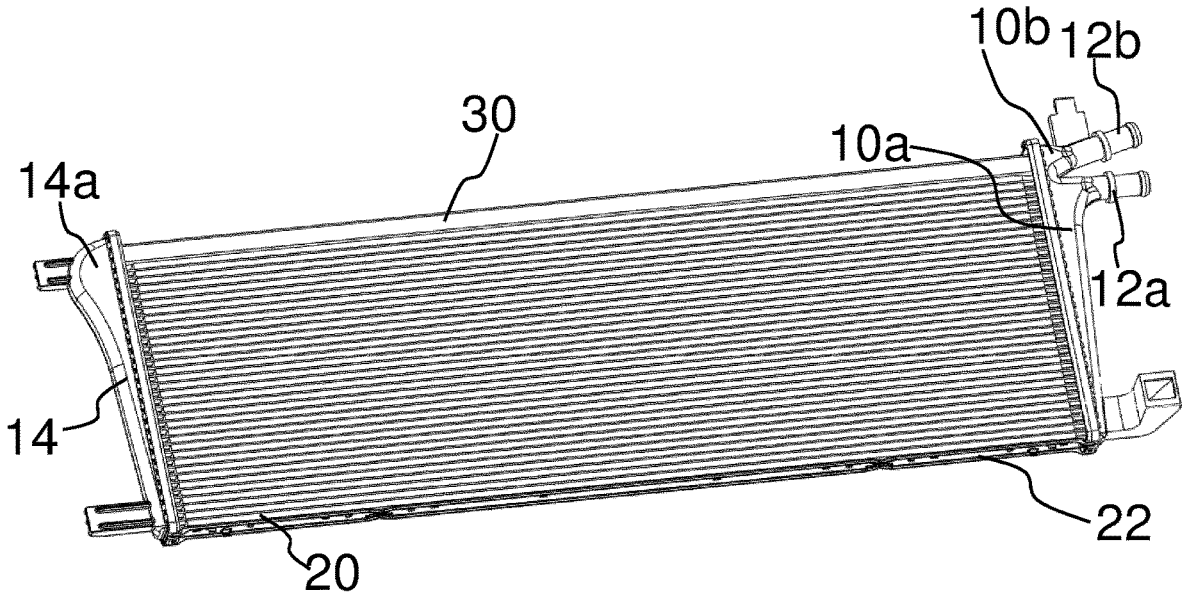
Figure 3B:
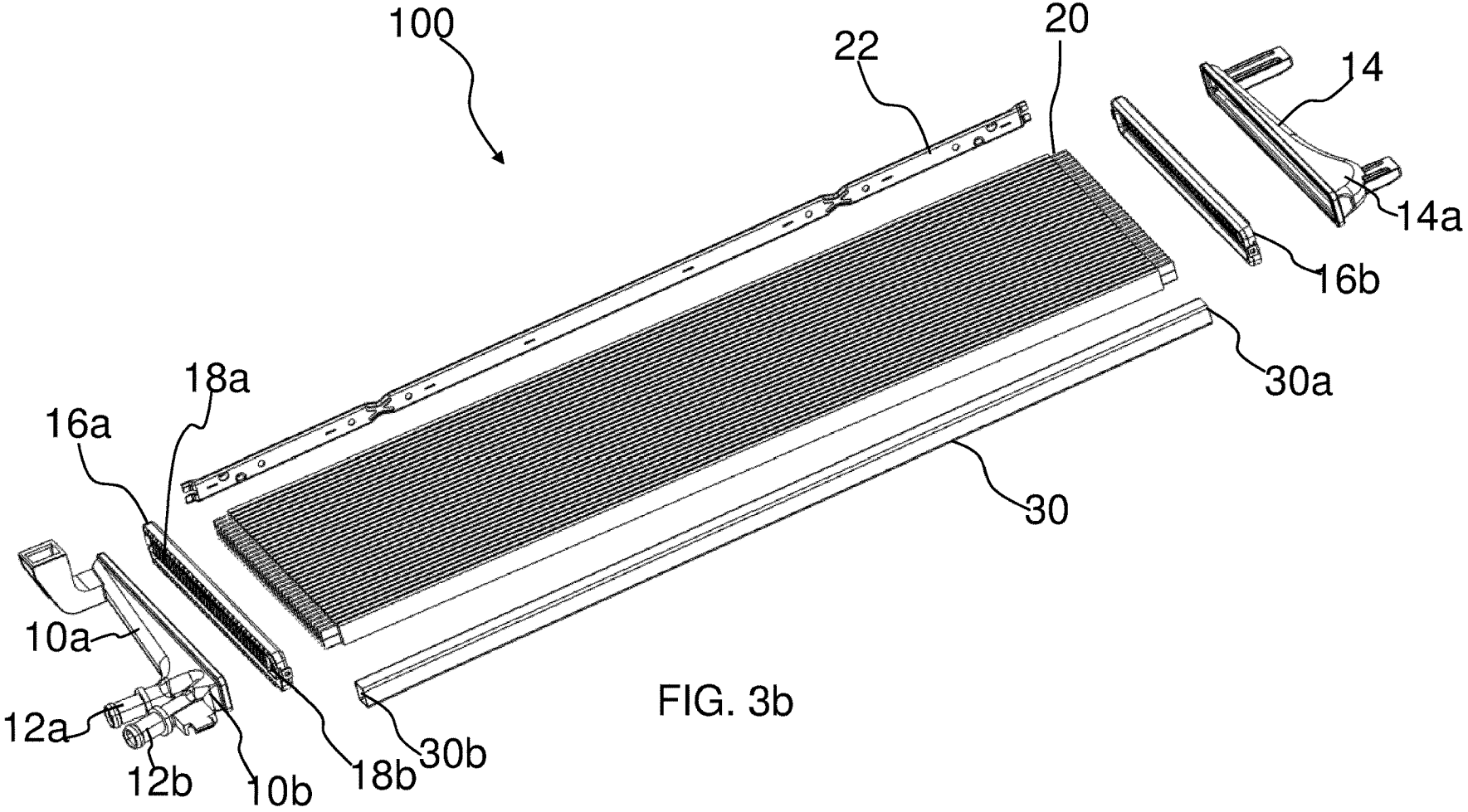

FIG. 3*a* illustrates an isometric view of a heat exchanger in accordance with an embodiment of the present invention, wherein an inlet tank and an outlet tank are separate tanks disposed on same side of the heat exchanger core;

FIG. 3*b* illustrates an exploded view of the heat exchanger of FIG. 3*a;*

Figure 4A:
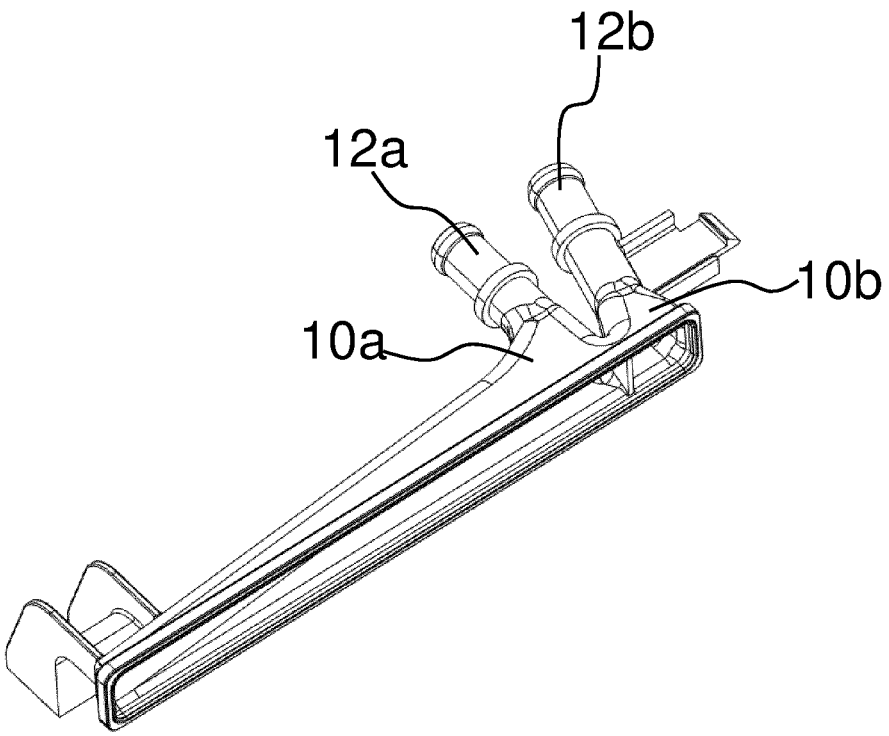

FIG. 4*a* illustrates an isometric view of the separate inlet tank and the outlet tank of the heat exchanger of FIG. 3*a;*

Figure 4B:
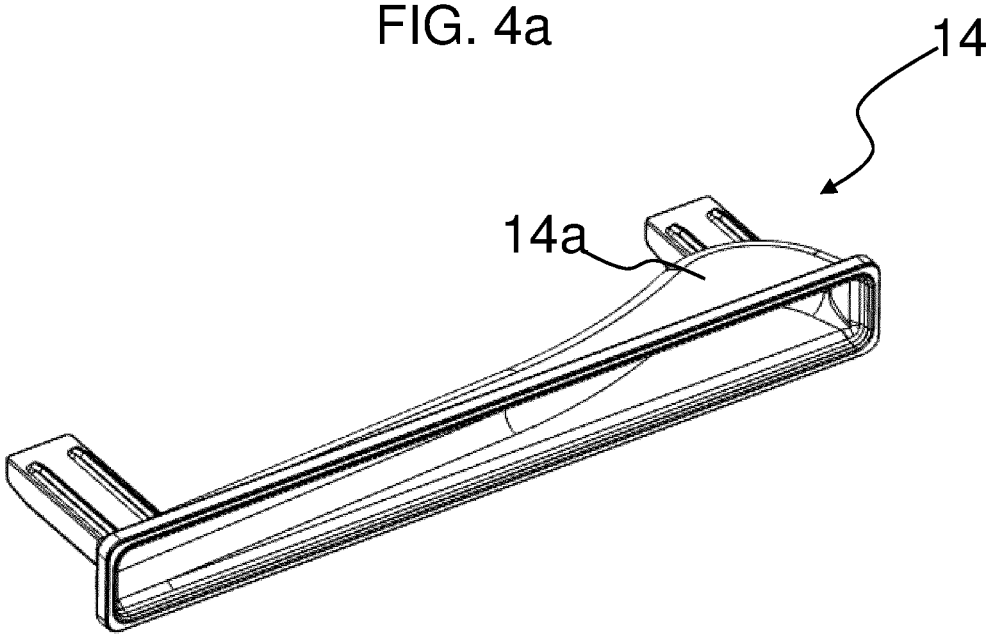

FIG. 4*b* illustrates an isometric view of the intermediate tank of the heat exchanger of FIG. 3*a;*

Figure 5A:
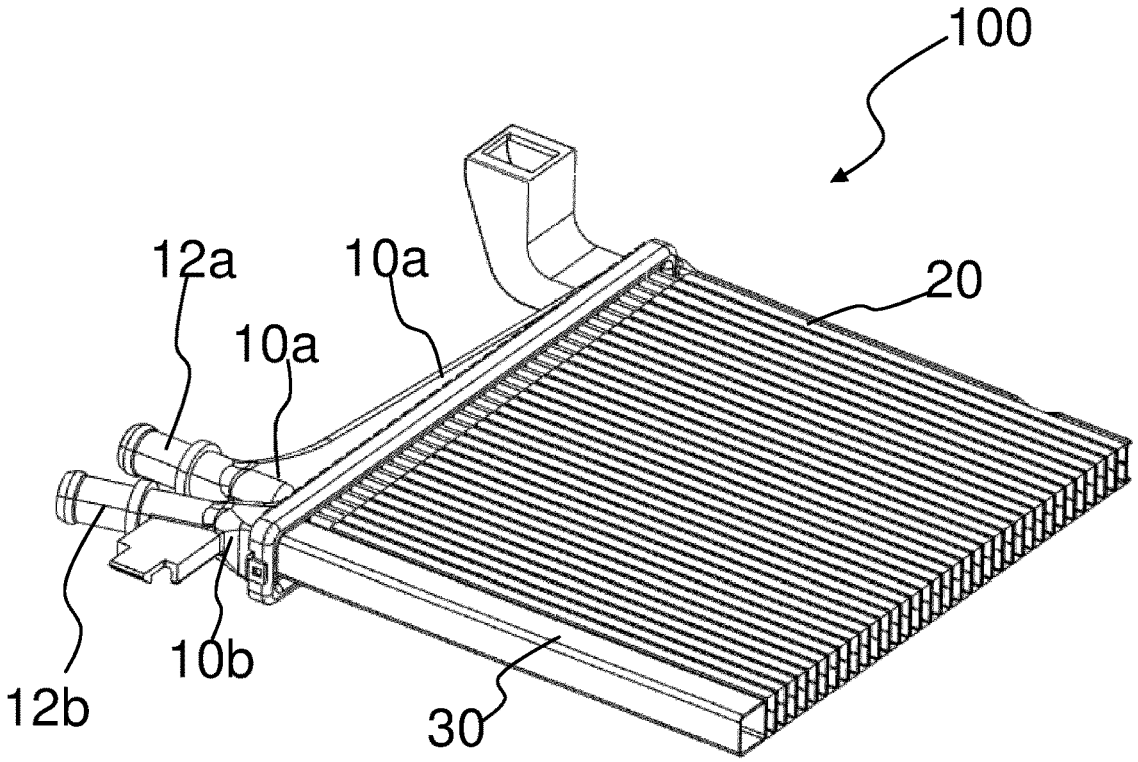
Figure 5B:
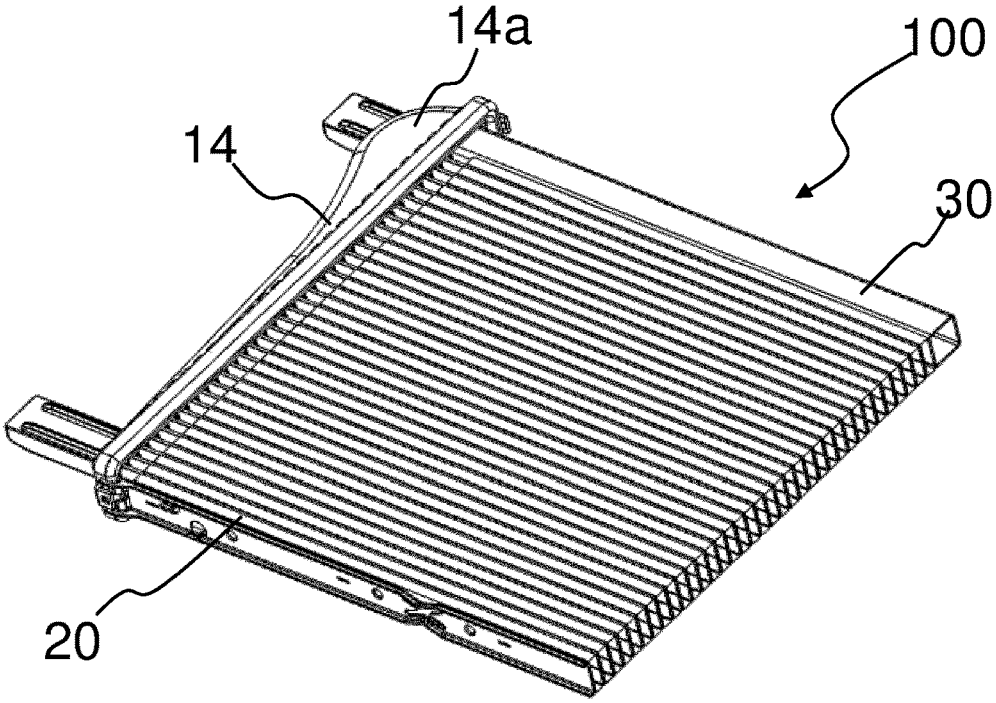

FIG. 5*a* illustrates a cut sectional isometric view of the heat exchanger of FIG. 3*a*, depicting a plurality of heat exchange tubes and a tubular element;

FIG. 5*b* illustrates another cut sectional isometric view of the heat exchanger of FIG. 3*a;*

Figure 6A:
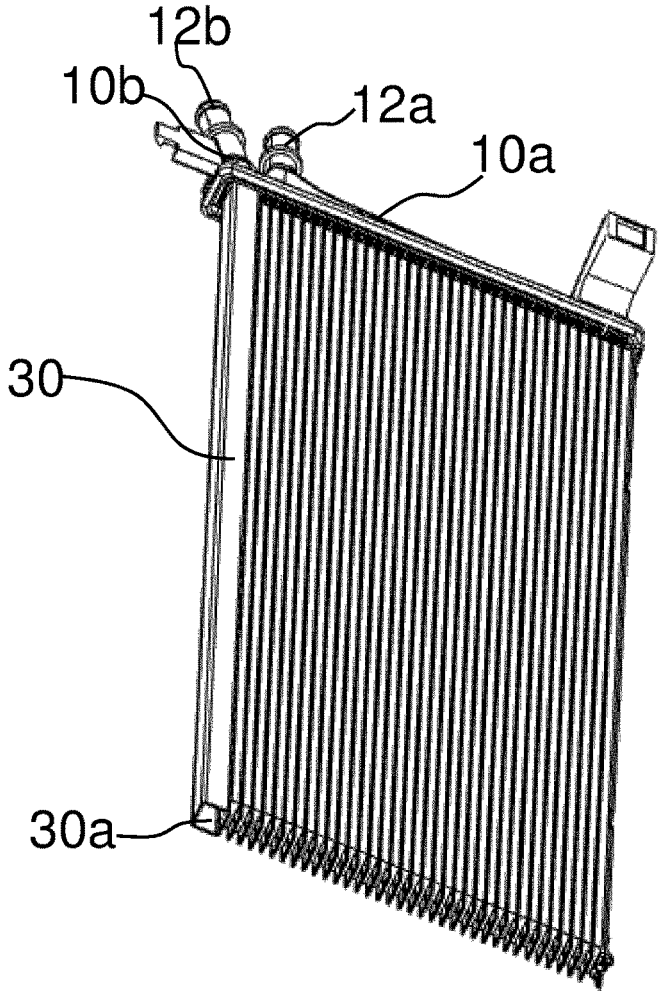
Figure 6B:
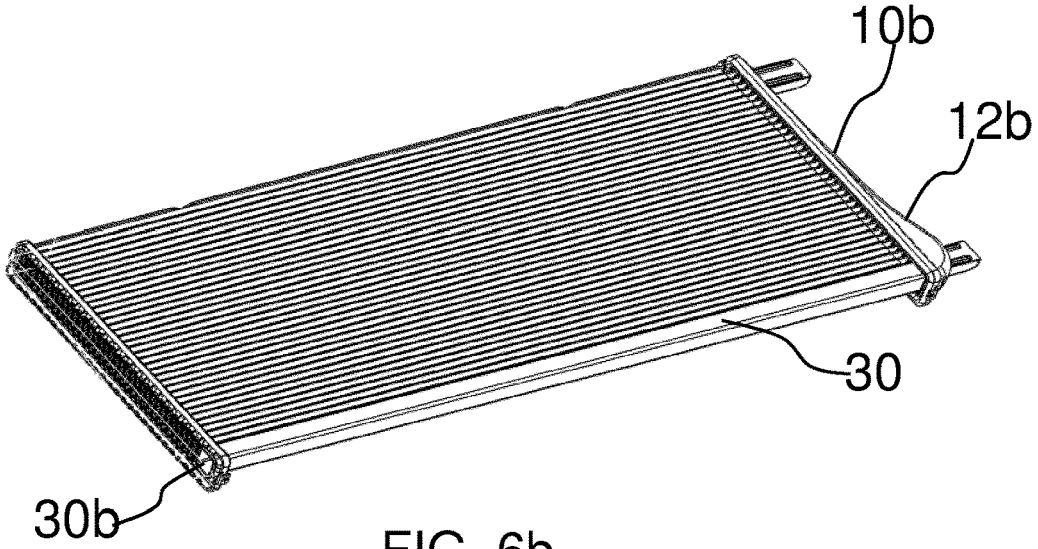

FIG. 6*a* illustrates an isometric view of the heat exchanger of FIG. 3*a*, without the intermediate tank; and FIG. 6*b* illustrates another isometric view of the heat exchanger of FIG. 3*a*, without the inlet tank and the outlet tank.

It must be noted that the figures disclose the invention in a detailed enough way to be implemented, said figures helping to better define the invention if needs be. The invention should however not be limited to the embodiment disclosed in the description.

The heat exchanger includes the inlet tank, the outlet tank, an intermediate tank and a plurality of heat exchange tubes. The plurality of heat exchange tubes receive a first heat exchange fluid from the inlet tank and delivers the first heat exchange fluid to the intermediate tank. More specifically, the first heat exchange fluid flows through the heat exchange tubes, in the process the first heat exchange fluid undergoes heat exchange with a second heat exchange fluid flowing across and around the heat exchange tubes. The tubular element enables fluid communication between the outlet tank and the intermediate tank. The outlet tank and the intermediate tank is configured with features to promote fluid flow through the tubular element. For example, a first side of the outlet tank is complimentary to and connected to an outlet pipe and a second side of the outlet tank opposite to the first side is complimentary to and aligned with the tubular element. The shape of the outlet tank transforms smoothly between the cross-sections of the tubular element and the outlet pipe along the fluid path. Such configuration ensures smooth transition of flow from the tubular element to the outlet pipe through the outlet tank, thereby preventing flow/energy losses. The tubular element and the outlet pipe are of different cross-section and dimension and the outlet tank is converging towards the first side thereof. At least one section of the intermediate tank at an entrance of the tubular element is larger than the remaining section of the intermediate tank to promote fluid flow through the tubular element. Although, the present invention is explained with an example of radiator, however, the present invention is also applicable for other heat exchangers, wherein the pressure drop across the tubular element is inherently decreased due to larger internal dimension thereof and the pressure drop across the whole heat exchanger is required to be decreased.

FIG. 1*a* illustrates a schematic representation of a conventional heat exchanger 1. FIG. 1*b* illustrates an exploded view of the conventional heat exchanger 1. The conventional heat exchanger includes a tank 2*a*, an intermediate tank 2*b* spaced apart from the tank 2*a* and a plurality of heat exchange tubes 4*a* disposed between the tank 2*a* and the intermediate tank 2*b* and forming a heat exchanger core 4. The conventional heat exchanger 1 further includes a tubular element 6 and an additional side element 7. The side element 7 is disposed between the tubular element 6 and one of the side plates 8*a*, 8*b*. As illustrated in the FIG. 1*b*, the heat exchange tubes 4*a* forming the core 4, the tubular element 6 and the additional side element 7 are sandwiched between a pair of side plates 8*a* and 8*b*. The opposite ends of the heat exchange tubes 4*a* and the tubular element 6 are received in respective slots formed on the corresponding headers 9*a* and 9*b*. The headers 9*a* and 9*b* are crimped to the tank 2*a* and the intermediate tank 2*b* respectively.

Referring to FIG. 2*a* and FIG. 2*b* of the accompanying drawings, the FIG. 2*a* illustrates an isometric view of the tank 2*a* with a baffle 3*a* disposed inside the tank 2*a* to configure an inlet tank 3*b* and an outlet tank 3*d* of the conventional heat exchanger 1. FIG. 2*b* illustrates an isometric view of the intermediate tank 2*b*. More specifically, the baffle 3*a* divides an interior of the tank 2*a* into a first portion defining the inlet tank 3*b* and a second portion defining the outlet tank 3*d*. The inlet tank 3*b* receives heat exchange fluid from an inlet pipe 3*c*. The inlet tank 3*b* is in fluid communication with and supplies the first heat exchange fluid received therein to the heat exchange tubes 4*a*. The plurality of heat exchange tubes 4*a* receive the first heat exchange fluid from the inlet tank 3*b* and delivers the first heat exchange fluid to the intermediate tank 2*b*. More specifically, the first heat exchange fluid flows through the heat exchange tubes 4*a*, in the process the first heat exchange fluid undergoes heat exchange with a second heat exchange fluid flowing across and around the heat exchange tubes 4*a*. The intermediate tank 2*b* collects the first heat exchange fluid that had passed through the heat exchange tubes 4*a*. The outlet tank 3*d* is in fluid communication with and receives the first heat exchange fluid collected in the intermediate tank 2*b* through the tubular element 6. The heat exchange fluid received in the outlet tank 3*d* egresses the outlet tank 3*d* through the outlet pipe 3*e*.

The conventional heat exchanger 1 may not be provided with means to sufficiently decrease the internal pressure drop across the whole heat exchanger 1. Accordingly, causing increase in internal pressure drop across the whole heat exchanger 1 that is detrimental for efficiency of the conventional heat exchanger 1. Further, the conventional heat exchanger 1 do not include any provision for smooth transition of fluid flow cross section, as the fluid flows from the additional tube to the outlet pipe through the outlet tank causing flow/energy losses. Accordingly, a higher capacity pump is required to counter issues such energy losses arising due to abrupt change in flow cross section and decrease in pressure drop across the tubular element 6. Accordingly, the overall costs of the heat exchanger 1 is increased. Further, the heat exchanger 1 with the additional tubular element 6 still requires the pair of side plates 8*a* and 8*b*. With more number of parts and requirement of higher power pump, the overall costs of the heat exchanger 1 is further increased.

FIG. 3*a* illustrates a heat exchanger 100 in accordance with an embodiment of the present invention. The heat exchanger 100 includes an inlet tank 10*a*, an outlet tank 10*b*, a plurality of heat exchange tubes 20, an intermediate tank 14 and a tubular element 30. The tubular element 30 is of rectangular section and comparatively larger diameter than the heat exchange tubes 30 to improve the fluid flow through the tubular element 30. The outlet tank 10*b* is separate from the inlet tank 10*a*. The inlet tank 10*a* is connected to and in fluid communication with an inlet pipe 12*a* for ingress of a first heat exchange fluid into the inlet tank 10*a*. The outlet tank 10*b* is connected to and is in fluid communication with an outlet pipe 12*b* for egress of the first heat exchange fluid from the outlet tank 10*b*. The inlet tank 10*a* and the outlet tank 10*b* are crimped to a first header 16*a* that includes a first set of slots 18*a* that receive one end of the plurality of heat exchange tubes 20. The first header also includes a first aperture 18*b* to receive one end of the tubular element 30 defining an exit 30*b* of the tubular element 30. The intermediate tank 14 is crimped to a second header 16*b* that includes a second set of slots 18*c* to receive opposite end of the plurality of heat exchange tubes 20 and a second aperture 18*d* to receive the opposite end 30*a* of the tubular element 30. With such configuration, the plurality of heat exchange tubes 20 and the tubular element 30 configure fluid communication between the inlet tank 10*a* and the outlet tank 10*b*.

In one example, the inlet tank 10*a* is in fluid communication with and supplies the first heat exchange fluid received therein to the heat exchange tubes 20. The plurality of heat exchange tubes 20 receive the first heat exchange fluid from the inlet tank 10*a* and deliver the first heat exchange fluid to the intermediate tank 14. Specifically, as the first heat exchange fluid flows through the heat exchange tubes 20, the first heat exchange fluid undergoes heat exchange with a second heat exchange fluid flowing across and around the heat exchange tubes 20. The intermediate tank 14 collects the first heat exchange fluid that had passed through the heat exchange tubes 20 and delivers the collected heat exchange fluid to the tubular element 30. The outlet tank 10*b* is in fluid communication with and receives the first heat exchange fluid collected in the intermediate tank 14 through the tubular element 30. The heat exchange tubes 20 and the tubular element 30 connecting the inlet tank 10*a* and the outlet tank 10*b* configure either one of I-flow, U-flow and Z-flow of the first heat exchange fluid, particularly coolant between the inlet tank 10*a* and the outlet tank 10*b*. In one example, the tubular element 30 forms a return flow passage from the intermediate tank 14 to the outlet tank 10*b*, in case the heat exchange tubes 20 along with the tubular element 30 are configuring U-flow. In another example, the tubular element 30 forms flow passage from the inlet tank 10*a* to the outlet tank 10*b*, in case the heat exchange tubes 20 along with the tubular element 30 are configuring I flow or Z flow. The main function of the tubular element 30 is fluid communication, particularly, enhance fluid flow between the inlet tank 10*a* and the outlet tank 10*b*, instead of heat exchange. Although there is heat exchange between the first heat exchange fluid flowing through the tubular element 30 and air flowing outside the tubular element 30, however, such heat exchange is limited. The tubular element 30 is of rectangular cross section instead of circular section, thereby lowering internal pressure drop across the tubular element 30. Such configuration of the tubular element 30 limits energy loss connected to transfer of fluid through the heat exchanger 100. Such configuration of the tubular element results in reduced flow through the tubular element 30, thereby defeating the purpose of the tubular element 30.

The inlet tank 10*a*, the intermediate tank 14 and the outlet tank 10*b* are configured with at least one feature to decrease pressure drop across the whole heat exchanger 100.

Referring to FIG. 3*b* and FIG. 4*a* of the accompanying drawings, the outlet tank 10*b* has a first side and a second side opposite to the first side. The first side of the outlet tank 10*b* is complimentary to and connected to the outlet pipe 12*b*. The second side of the outlet tank 10*b* is complimentary to and aligned with the tubular element 30. The tubular element 30 and the outlet pipe 12*b* are co-axial. Alternatively, the tubular element 30 and the outlet pipe 12*b* are at an angle with respect to each other. The inlet pipe 12*a* and the outlet pipe 12*b* are parallel with respect to each other. Alternatively, the inlet pipe 12*a* and the outlet pipe 12*b* are at an angle with respect to each other. As illustrated in the accompanying FIGS. 3*a*-3*b*, 4*a*, 5*b*, the inlet pipe 12*a* and the outlet pipe 12*b* are at an angle to each other. The angle between the inlet pipe 12*a* and the outlet pipe 12*b* is selected to address the packaging issues. The tubular element 30 and the outlet pipe 12*b* are of different cross-section. Particularly, the outlet pipe 12*b* is of circular cross section and the tubular element 30 is of rectangular cross section, the cross section of the outlet tank 10*b* changes from circular at the first side thereof to rectangular at the second side thereof. In accordance with another embodiment, the outlet pipe 12*b* is of circular cross section and the tubular element 30 is of square or rectangular cross section, the cross section of the outlet tank 10*b* changes from circular at the first side thereof to square or rectangular at the second side thereof. In still another embodiment, the tubular element 30 and the outlet pipe 12*b* are of same cross sectional area and different shapes. The outlet tank's 10*b* shape transforms smoothly from the cross-section of the tubular element 30 to the cross section of the outlet tank 10*b* along the fluid path. Such configuration of the outlet tank 10*b* ensures smooth transition of flow cross section as the first heat exchange fluid flows from the additional tube to the outlet pipe through the outlet tank, thereby preventing flow/energy losses. The outlet tank 10*b* is of larger dimension at the second side thereof aligned with the tubular element 30 as compared to the first side thereof connected to the outlet pipe 12*b*, thereby the outlet tank 10*b* is converging towards the first side thereof. Such converging configuration of the outlet tank 10*b* promotes fluid flow through the tubular element 30. Such configuration of the outlet tank 10*b*, promotes smooth and undisrupted fluid flow from the tubular element 30 to the outlet pipe 12*b*.

Further referring to FIG. 3*a*, FIG. 3*b*, FIG. 4*a* and FIG. 5*a* the inlet tank 10*a* is of variable cross section and the cross section thereof is decreasing in a direction away from the inlet pipe 12*a*. The inlet pipe 12*a* is disposed proximal to an interface between the inlet tank 10*a* and the outlet tank 10*b* and fluid flows away from the inlet pipe 12*a*. With such configuration of the inlet tank 10*a*, the first heat exchange fluid is uniformly distributed across the inlet tank 10*a*. More specifically, with such configuration of the inlet tank 10*a*, the first heat exchange fluid entering inside the inlet tank 10*a* through the inlet pipe 12*a* reaches even that portion of the inlet tank 10*a* that is farthest from the inlet pipe 12*a*. With such configuration of the inlet tank 10*a*, the first heat exchange fluid is uniformly distributed in the heat exchange tubes 20.

Further referring to FIG. 3*a*, FIG. 3*b* and FIG. 4*b*, the intermediate tank 14 is of variable cross section and the cross section thereof is increasing towards the entrance 30*a* of the tubular element 30 with maximum cross section at the entrance 30*a* of the tubular element 30. With such configuration the first heat exchange fluid collected in the intermediate tank 14 is accumulated in a section 14*a* of the intermediate tank 14 that is at the entrance 30*a* of the tubular element 30, thereby improving the fluid flow through the tubular element 30. More specifically, variable cross sectional configuration of the intermediate tank 14 with the cross section thereof increasing towards the entrance 30*a* of the tubular element 30 and converging configuration of the outlet tank 10*b* in combination increases the pressure drop across the tubular element 30.

Such modifications in the inlet tank 10*a*, the outlet tank 10*b* and the intermediate tank decreases the internal pressure drop across the whole heat exchanger 100, thereby enhancing the efficiency of the heat exchanger 100. Further, such configuration of the heat exchanger 100 with improved fluid flow through the tubular element 30, requires small capacity/power pump and as such the heat exchanger 100 is inexpensive compared to conventional heat exchangers.

The tubular element 30 also acts as a side plate, thereby eliminating the need for a dedicated component acting as a side plate. Comparing the exploded view of the heat exchanger 100 of the present invention as illustrated in FIG. 3*b* with the conventional heat exchanger 1 illustrated in FIG. 1*b*, two side plates 8*a* and 8*b* are used in the conventional heat exchanger 1, whereas the tubular element 30 used in the heat exchanger 100 of the present invention functions as side plate on one side of the heat exchanger core and only a single side plate 22 is required on the other side of the heat exchanger core.

Several modifications and improvement might be applied by the person skilled in the art to a heat exchanger as defined above, and such modifications and improvements will still be considered within the scope and ambit of the present invention, as long as it is comprising an inlet tank connected to and in fluid communication with an inlet pipe for ingress of a coolant therein, an outlet tank connected to and in fluid communication with an outlet pipe for egress of coolant there from. The heat exchanger further includes heat exchange tubes and a tubular element to configure fluid communication between the inlet tank and the outlet tank. A first side of the outlet tank is complimentary to and connected to the outlet pipe and an opposite second side of the outlet tank is complimentary to and aligned with the tubular element. The tubular element and the outlet pipe are of different cross sections, wherein shape of the outlet tank transforms smoothly between those cross sections along fluid path.

The invention claimed is:

1. A heat exchanger comprising:

an inlet tank connected to and in fluid communication with an inlet pipe for ingress of a first heat exchange fluid into the inlet tank;

an outlet tank connected to and in fluid communication with an outlet pipe for egress of the first heat exchange fluid from the outlet tank;

a plurality of heat exchange tubes and a tubular element adapted to configure fluid communication between the inlet tank and the outlet tank, and an intermediate tank in fluid communication with the heat exchange tubes and the tubular element, the intermediate tank being adapted to collect the first heat exchange fluid from the heat exchange tubes and deliver the collected first heat exchange fluid to the tubular element, wherein a first side of the outlet tank is complimentary to and connected to the outlet pipe and a second side of the outlet tank opposite to the first side is complimentary to and aligned with the tubular element, the tubular element and the outlet pipe being of different cross-sections, wherein a cross section of the outlet tank gradually transitions from a cross-section of the outlet pipe to a cross-section of the tubular element along the fluid path, wherein the intermediate tank is of variable cross section and the cross section thereof increases towards an entrance of the tubular element.

2. The heat exchanger as claimed in claim 1, wherein the inlet tank is in fluid communication with and adapted to supply the first heat exchange fluid to the heat exchange tubes and the outlet tank is in fluid communication with and adapted to collect the first heat exchange fluid only from the tubular element.

3. The heat exchanger as claimed in claim 1, wherein the inlet tank is of variable cross section and the cross section thereof is decreasing in a direction away from the inlet pipe.

4. The heat exchanger as claimed in claim 1, wherein the tubular element and the outlet pipe are of same cross sectional area and different shapes.

5. The heat exchanger as claimed in claim 1, wherein the tubular element and the outlet pipe are co-axial.

6. The heat exchanger as claimed in claim 1, wherein the tubular element and the outlet pipe at an angle with respect to each other.

7. The heat exchanger as claimed in claim 1, wherein the inlet pipe and the outlet pipe are parallel with respect to each other.

8. The heat exchanger as claimed in claim 1, wherein the inlet pipe and the outlet pipe are at an angle with respect to each other.

9. The heat exchanger as claimed in claim 1, wherein the inlet pipe is disposed proximal to an interface between the inlet tank and the outlet tank and fluid flows away from the inlet pipe.

10. The heat exchanger as claimed in claim 1, wherein the inlet tank and the outlet tank are crimped to a first header that comprises a first set of slots adapted to receive one end of the plurality of heat exchange tubes and a first aperture adapted to receive one end of the tubular element.

11. The heat exchanger as claimed in claim 1, wherein the outlet pipe is of circular cross section and the tubular element is of rectangular cross section, the cross section of the outlet tank changes from circular at the first side thereof to rectangular at the second side thereof.

12. The heat exchanger as claimed in claim 1, wherein the outlet pipe is of circular cross section and the tubular element is of square cross section, the cross section of the outlet tank changes from circular at the first side thereof to square at the second side thereof.

13. The heat exchanger as claimed in claim 1, wherein:

the outlet tank is of larger dimension at the second side as compared to the first side, and the outlet tank has a convergent shape from the second side to the first side, the convergent shape delimited by a contour of the gradually transitioning cross section of the outlet tank.

14. The heat exchanger as claimed in claim 1, wherein the plurality of heat exchange tubes and the tubular element are adapted to configure a U-flow.

15. The heat exchanger as claimed in claim 1, wherein a maximum cross section of the intermediate tank is attained at the entrance of the tubular element.

* * * * *